United States Patent [19]

Giotis

[11] Patent Number: 4,798,017

[45] Date of Patent: Jan. 17, 1989

[54] TRAFFIC DIRECTING SIGN

[76] Inventor: George A. Giotis, 124 Timberline Dr., Williamsville, N.Y. 14221

[21] Appl. No.: 938,383

[22] Filed: Dec. 5, 1986

[51] Int. Cl.[4] ..... G09F 7/02

[52] U.S. Cl. ..... 40/612; 116/63 P; 40/607; 40/602

[58] Field of Search ..... 116/63, 63 P; 40/584, 40/612, 606, 607, 602

[56] References Cited

U.S. PATENT DOCUMENTS

| | | | |
|---|---|---|---|
| 814,101 | 3/1906 | Weel | 40/607 |
| 965,566 | 7/1910 | Cooley | 40/607 |
| 2,552,745 | 5/1951 | Stanley et al. | 40/607 |
| 2,800,734 | 7/1957 | Blackburn | 40/602 |
| 3,210,010 | 11/1965 | Hyatt | 40/602 |
| 3,422,556 | 1/1969 | Lyons et al. | 40/10 |
| 3,623,255 | 11/1971 | Girard | 40/607 |
| 3,646,696 | 3/1972 | Sarkisian | 40/125 H |
| 3,662,482 | 5/1972 | Sarkisian | 40/125 H |
| 3,828,455 | 8/1974 | Bentley | 40/602 |
| 4,033,536 | 7/1977 | Hillstrom | 248/160 |
| 4,265,040 | 5/1981 | Sarkisian | 40/618 |
| 4,288,053 | 9/1981 | Sarkisian | 248/218.4 |
| 4,365,435 | 12/1982 | Snyder | 40/602 |
| 4,516,344 | 5/1985 | Seely | 40/602 |
| 4,694,601 | 9/1987 | Dicke et al. | 40/610 |

*Primary Examiner*—Gene Mancene
*Assistant Examiner*—Wenceslao Contreras
*Attorney, Agent, or Firm*—Bean, Kauffman & Bean

[57] ABSTRACT

A panel of flexible but resilient material is supported on a post along a vertical axis in such a fashion that those portions of the panel extending beyond the post are permitted to flex under a given wind load.

5 Claims, 2 Drawing Sheets

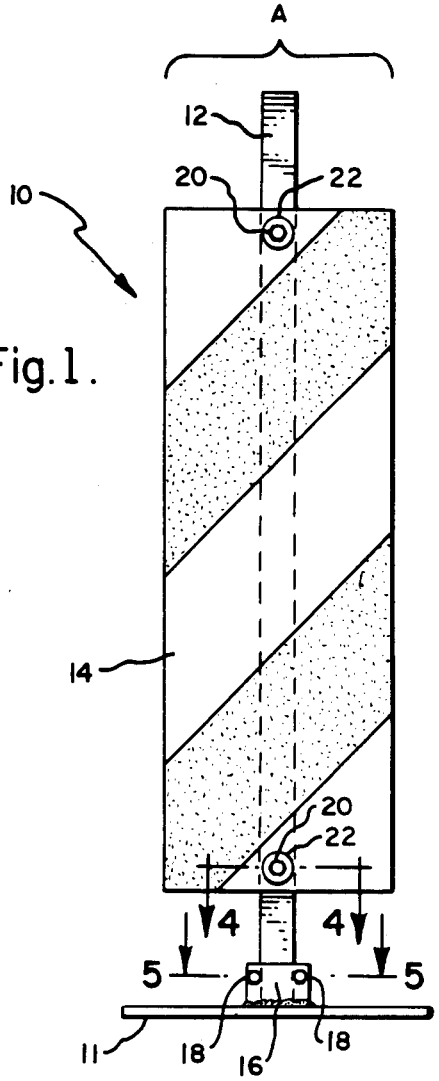
Fig. 1.
Fig. 2.
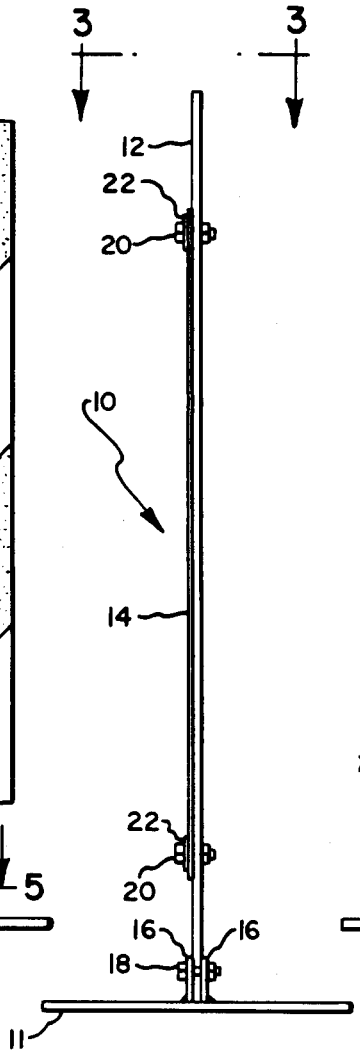
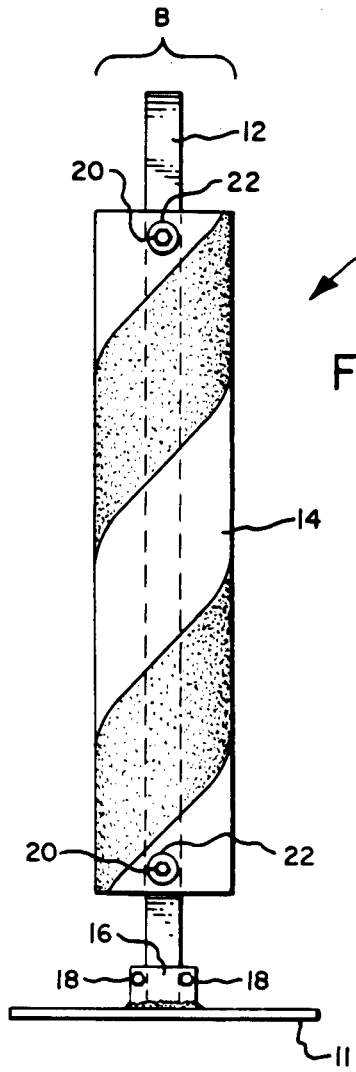
Fig. 9.
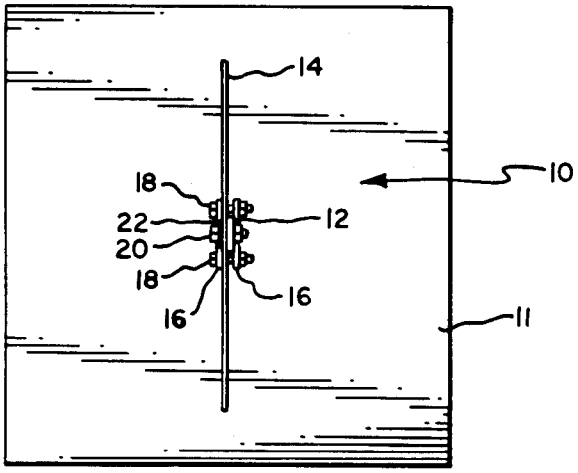
Fig. 3.

Fig. 4.
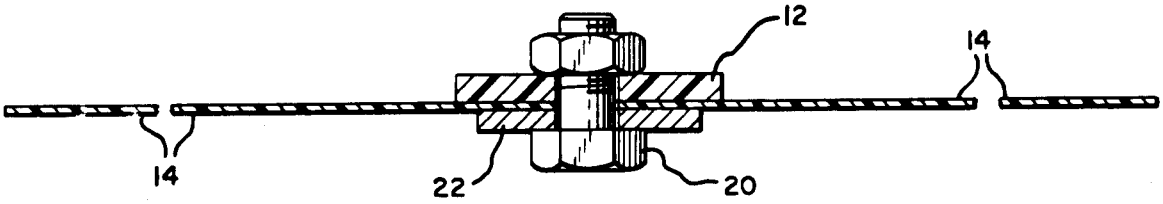
Fig. 5.
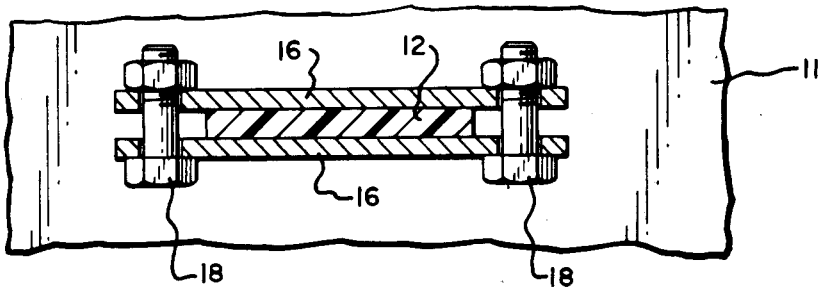
Fig. 6.
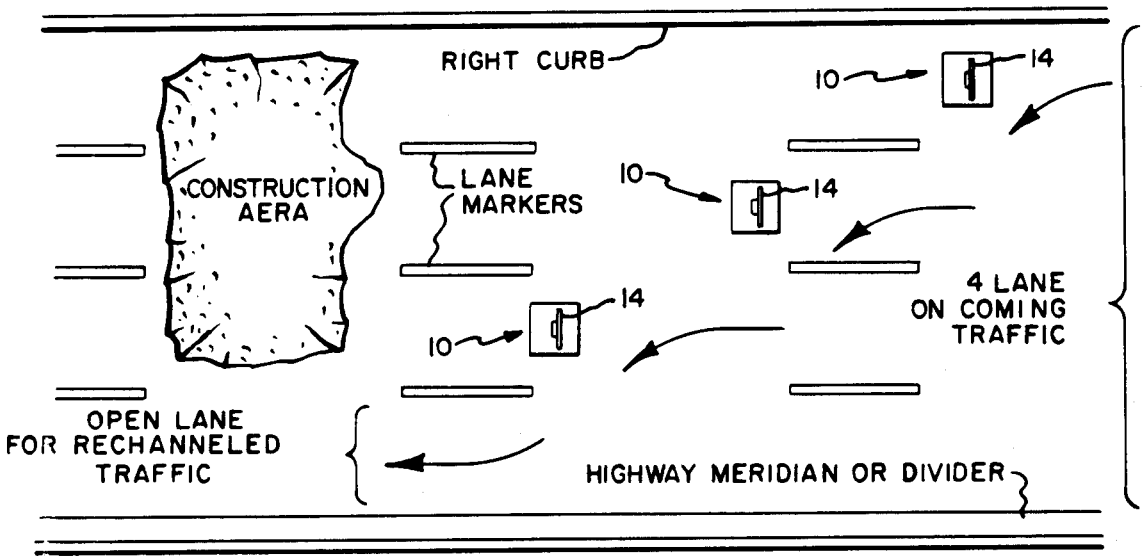
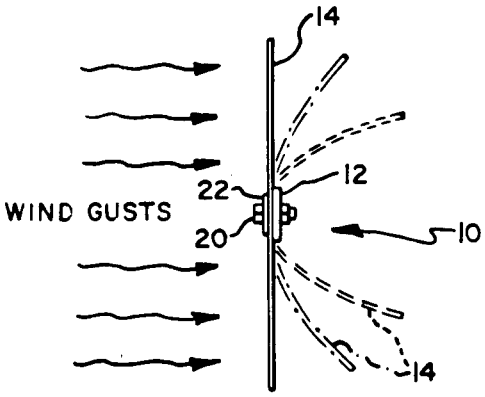
Fig. 7.
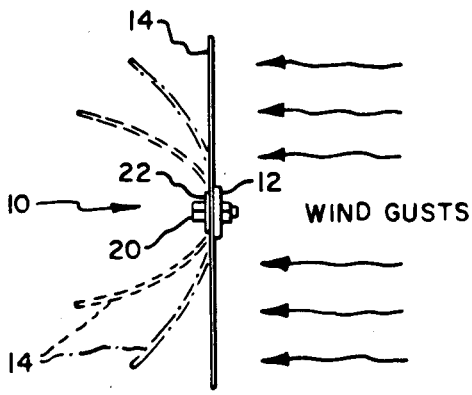
Fig. 8.

TRAFFIC DIRECTING SIGN

BACKGROUND OF THE INVENTION

This invention relates to vehicular traffic directing signs such as basically comprise variously shaped upstanding panels mounted on base plates or the like so as to face oncoming traffic some of which have printings thereon reading for example "Stop"; "Slow"; "Road Closed"; "Detour", or the like. However, some signs such as multiple lane traffic rechanneling devices usually contain no printed instructions; the panels thereof being painted with diagonally directed contrasting colored light reflective stripes, according to specifications by government transportation agencies.

It is the object of the present invention however to provide traffic control signs of the above referred types which are improved in various important respects. For example, they should be less vulnerable to mechanical damaging such as may be caused by vehicles colliding therewith and/or by being upset by wind gusts or the like. In the event of damage, they should be repairable at lower costs. They should be more readily portable and require little or no sandbagging to maintain them in upstanding positions against normally encountered wind conditions. If struck by a moving vehicle or person, they should inflict much less damage or injury upon the vehicle or the person. They should be lightweight, economically manufactured and maintained, and more readily transported and otherwise handled compared to prior art devices.

BRIEF SUMMARY OF THE INVENTION

In the case of the present invention, improvements in the design and construction of the three essential components of the overall assembly uniquely cooperate to provide importantly improved devices of the above referenced types. The base plate, integral post holder, panel support post, and the message carrying panel components thereof combine to provide an assembly that is less vulnerable to high or gusty winds while at the same time being of overall lighter weight and requiring, if any, minimum sandbagging to prevent toppling. On the other hand, the device offers less resistance to topplings as a result of vehicles or persons colliding therewith; and accordingly, damages to such vehicles and/or persons are less.

In the case of the present invention, the panel is formed with a frontal area of appropriate shape from a stock sheet of any suitable resilient material which may for example be of the plastic, natural or synthetic rubber, or spring metal type, or the like; and in the case of a base plate supported device the panel is fixed along its vertical mid section to a relatively slender post which extends upwardly from a base plate. Thus, because of the flexibility of the panel material at opposite sides of the post, upon impacts of wind pressures thereon the side portions of the panel temporarily roll rearwardly away from the wind relative to the post, thereby temporarily "spilling" the wind pressure effects. Accordingly, the tendency to topple the device is greatly reduced compared to devices emplying rigid panels or the like. Vehicles or persons coming into contact with devices of the invention are similarly met with less rigidly standing resistance, and therefore suffer lesser damages and/or injuries.

The base plate carries integral therewith a releasable post holding device. In event of an accident causing the post to break away from the base above the holder, the post and panel unit may simply be vertically reversed and remounted on the base plate by inserting the formerly top end of the post into the holder and clamping it in place.

BRIEF DESCRIPTION OF THE DRAWINGS

FIG. 1 is a front elevational view of a so-called traffic "rechanneling" sign device incorporating features of the present invention which is of the type such as are employed temporarily to direct multi-lane traffic flows so as to avoid obstacles in the normal traffic flow pattern;

FIG. 2 is a side view of the device of FIG. 1 when standing upright against oncoming traffic in a normal operating (no or low) wind condition;

FIG. 3 is a top plan elevational view of the device as shown in FIGS. 1 and 2;

FIG. 4 is an enlarged scale sectional view taken as along line 4—4 of FIG. 1;

FIG. 5 is an enlarged scale sectional view taken as along line 5—5 of FIG. 1;

FIG. 6 is a diagrammatic plan view of a typical highway repair operation employing in association therewith devices of the invention which are being employed to divert and rechannel the flow of traffic away from and around the repair operations;

FIGS. 7 and 8 are schematic top plan views illustrating how the traffic control message carrying panel portion of the device of the invention responds temporarily to the onslaughts of wind gusts when impacting against opposite front and rear sides thereof; and FIG. 9 is a view corresponding to FIG. 1, but illustrates how the message carrying panel thereof appears to oncoming traffic when it is yielding momentarily to pressure and spilling a wind gust or the like.

DETAILED DESCRIPTION OF THE INVENTION

As illustrated by the drawing herewith, a preferred embodiment of the invention as identified generally by the numeral 10 comprises in operative combination, a base plate 11; a post 12; and a traffic control message carrying panel 14. The base plate 11 is preferably formed of relatively heavy plate metal or the like, and may be of any rectangular or circular or other shape and so sized as to provide the solidarity requisite to maintenance of the device in an upstanding position (either with or without some "sandbagging") against the anticipated top wind pressures to be encountered at the installation site. The base plate 11 has provided integral therewith a post clamping device comprising a pair of spaced apart upstanding cuff members 16—16 which are apertured at their opposite ends to accommodate bolt and nut devices 18—18, or any other suitable locking means.

The post member 12 may of course be of a large variety of sectional shapes and formed of a large variety of materials. However, in any case, in accordance with the invention the post 12 will be formed of a strong but tough and somewhat elastic material, but having also most importantly, a highly resilient characteristic. The traffic control message carrying panel 14 is formed of any suitable weather resistant flexible but highly resilient sheet material, and is affixed along its vertical mid section to the post 12 such as by way of example by means of nut and bolt units 20 having washers 22 bearing against the face of the panel 14 opposite to that which is against the post 12.

Thus, as illustrated at FIGS. 7 and 8, whenever wind pressure effects cause the opposite side portions of the panel 14 to roll away and avoid the maximum pressure effects of the wind upon the device, oncoming traffic is nevertheless faced with a clearly visible (although momentarily and only slightly widthwise dimensionally reduced) message carrying area such as indicated by the symbol B at FIG. 9 whereas the area is normally of the width shown at A (FIG. 1).

Accordingly, it will be appreciated that the present invention provides an importantly improved traffic control device which at all times remains effective, while at the same time it is adapted to "spill" the onslaughts of excessive wind pressures as well as the effects of collisions thereagainst such as by vehicles and/or persons; whereby injuries to such persons and/or damages to such vehicles and to the device itself are minimized.

I claim:

1. In a traffic directing sign device which includes in combination; a stabilizing base member having a post mounting means on the upper surface thereof, and a flat bottom surface whereby said sign device is adaptd to be set upon a highway surface in laterally slidable relation thereon; a post member detachably connected at its bottom end portion to said mounting means of said base member so as to extend vertically therefrom; and a traffic directing information carrying panel member formed of a flexible highly resilient normally flat sheet material detachably mounted along its vertical mid section upon said post member, whereby the opposite side portions of said panel are free to flex and allow wind gusts to slip around the post supported panel portion thereof while applying substantially reduced sign device toppling tending forces thereagainst; the improvement comprising:

said mounting means comprises a releasable clamping device; and the opposite top and bottom end portions of said post member are similarly shaped and sectionally configured and dimensioned so that in event said post is broken off at its bottom end clamped connection to said base member the broken away part may be removed and said post member upended and readily reinserted into locked position within said clamping device.

2. A traffic directing sign device as set forth in claim 1, wherein said post member is formed of a fiberglass reinforced polymeric material.

3. A traffic directing sign device as set forth in claim 2, wherein said panel member is formed of Mylar TM sheet material.

4. A traffic directing sign device as set forth in claim 1, wherein said clamping device comprises a pair of plate-like cuff members extending integrally from said base member in upright standing parallel relation;

said cuff members being spaced apart so as to receive either end portion of said post member in snug slide fitting relation therein and having manually adjustable means associated therewith for tightening the grip of said clamping device upon said post member.

5. A traffice directing sign device as set forth in claim 4 wherein said cuff members are formed of resilient material and wherein said adjustable means comprise screw threaded devices extending from one of said plates to another along opposite sides of said post member.

* * * * *